US005195595A

United States Patent [19]

Nakagawa

[11] Patent Number: 5,195,595

[45] Date of Patent: Mar. 23, 1993

[54] FIRE EXTINGUISHER MOUNTING APPARATUS

[76] Inventor: Henry Nakagawa, 358 Clifton Ave., San Carlos, Calif. 94070

[21] Appl. No.: 929,708

[22] Filed: Aug. 12, 1992

[51] Int. Cl.[5] ..... A62C 39/00

[52] U.S. Cl. ..... 169/51; 206/45.34; 220/4.24

[58] Field of Search ..... 169/51, 48; 220/265, 220/266, 315, 4.24; 312/138.1, 248; 206/45.34

[56] References Cited

U.S. PATENT DOCUMENTS

| | | | |
|---|---|---|---|
| D. 251,464 | 4/1979 | Masters | 169/51 X |
| 3,067,822 | 12/1962 | Hattenhauer | 169/51 |
| 3,220,791 | 11/1965 | Pokryfke | 169/51 X |
| 3,722,733 | 3/1973 | Neumann | 169/51 X |
| 4,017,334 | 4/1977 | Sigler | 169/51 X |
| 4,034,697 | 7/1977 | Russell | 169/51 X |
| 4,046,439 | 9/1977 | Lee | 169/51 X |
| 4,380,269 | 4/1983 | Petaway et al. | 169/51 |
| 4,449,588 | 5/1984 | Benlolo et al. | 169/51 X |
| 4,763,732 | 8/1988 | Neal | 169/51 |
| 4,998,587 | 3/1991 | Thomas | 169/51 |

*Primary Examiner*—Russell D. Stormer
*Assistant Examiner*—James M. Kannofsky
*Attorney, Agent, or Firm*—McCubbrey, Bartels, Meyer & Ward

[57] ABSTRACT

A cabinet structure is described for enclosing a fire extinguisher or the like. The cabinet structure comprises a housing having a permanently hinged access panel which pivots away from the housing to permit access to its contents. The access panel is secured to the housing when in a closed position by one or more shear members of sufficient frangibility that, in response to the application of a predetermined force to a handle on the access panel, the shear members are severed, permiting the access panel to be pivoted to an open position.

7 Claims, 3 Drawing Sheets

FIRE EXTINGUISHER MOUNTING APPARATUS

TECHNICAL FIELD

The present invention relates to cabinet structures for enclosing fire extinguishers and, more particularly, to a fire extinguisher mounting apparatus for protectively storing a fire extinguisher or other like stored articles.

BACKGROUND OF THE INVENTION

Conventional cabinet structures for storing fire extinguishers generally include a housing having an opening for receiving the fire extinguisher and a breakable door or cover lockably mounted on the housing over the opening for secure storage of the fire extinguisher while permitting emergency access thereto. The housing is generally formed of a high impact plastic material or metal. Illustrative are the prior art cabinet constructions disclosed in U.S. Pat. Nos. 3,067,822; 3,220,791; 3,722,733; 4,034,697; 4,046,439; 4,449,588 and 4,763,732.

Although these prior art fire extinguisher cabinet structures are believed to function adequately for their common intended purpose, the structure that provides the attaching relationship of the cover on the housing and the securing mechanism are normally complicated and, therefore, expensive to fabricate. For example, the cabinet structure disclosed in U.S. Pat. No. 4,763,732 includes a frangible hinge tab to secure the cover to the housing. The hinge tab is breakable in response to the application of a pulling force on a grip to facilitate emergency access to the cabinet. The hinge tab is, however, an integral part of the cover. Therefore, since emergency access destroys the hinge tab, the entire cover must be replaced after every emergency use.

The noted patent further requires a plurality of mating flange members and hinge tabs to align the cover when mounted on the housing, adding expense and complexity. Finally, the disclosed cabinet structure also requires a conventional padlock to facilitate secure locking of the cabinet structure, which adds further expense to the apparatus.

It is, accordingly, an object of the present invention to provide an improved fire extinguisher mounting apparatus for storing a fire extinguisher or other like stored article which is simple in construction and reliable in operation.

It is another object of the present invention to provide an improved fire extinguisher mounting apparatus which employs a simple and inexpensive securing mechanism that eliminates the need to replace the entire cover after each emergency use.

Other objects of the invention will become apparent to those skilled in the art from the following description and accompanying designs and claims.

SUMMARY OF THE INVENTION

The disclosed fire extinguisher mounting apparatus substantially reduces or eliminates the disadvantages and shortcomings associated with the prior art techniques. The apparatus is simple in construction and employs a replaceable inexpensive securing means that eliminates the need to replace the entire cover after each emergency use.

Generally, the apparatus includes a housing adapted for receiving a fire extinguisher or other like stored article, and an access panel adapted for mounting over the opening of the housing. A permanent hinge arrangement is operatively connected to the housing and access panel at one corresponding edge thereof to permit pivotal interengagement of the housing and access panel. A handle is provided to permit manual pivoting of the access panel about the hinge arrangement.

A securing arrangement is also provided to prevent disengagement of the access panel when in a closed position and adapted to permit selective disengagement of the access panel to an open position. The securing arrangement includes one or more shear members of sufficient frangibility in response to the application of a predetermined force to the handle to sever the shear member(s), permitting the access panel to be disengaged from the housing and pivoted to the open position.

BRIEF DESCRIPTION OF THE DRAWINGS

Further features and advantages will become apparent from the following and more particular description of the preferred embodiment of the invention, as illustrated in the accompanying drawings, in which like reference characters generally refers to the same parts or elements throughout the views, and in which.

DETAILED DESCRIPTION OF THE INVENTION

In accordance with the present invention, the disclosed fire extinguisher mounting apparatus substantially reduce or eliminates the disadvantages and shortcomings associated with the prior art techniques. According to the invention, a housing having an opening therethrough and defining a containment area accessible through the opening, and an access panel adapted for mounting over the opening of the housing for enclosing the containment area, are generally provided to store a fire extinguisher or other like stored articles. A highly important technical advantage of the invention is that the access panel is secured to the housing by virtue of one or more inexpensive shear members. The shear members are designed and configured to be forcibly disengaged to facilitate access to the containment area in emergency situations in response to the application of a predetermined force pulling the handle means away from the housing. To re-secure the access panel to the housing, one need only to replace the inexpensive shear members.

Figure 1:
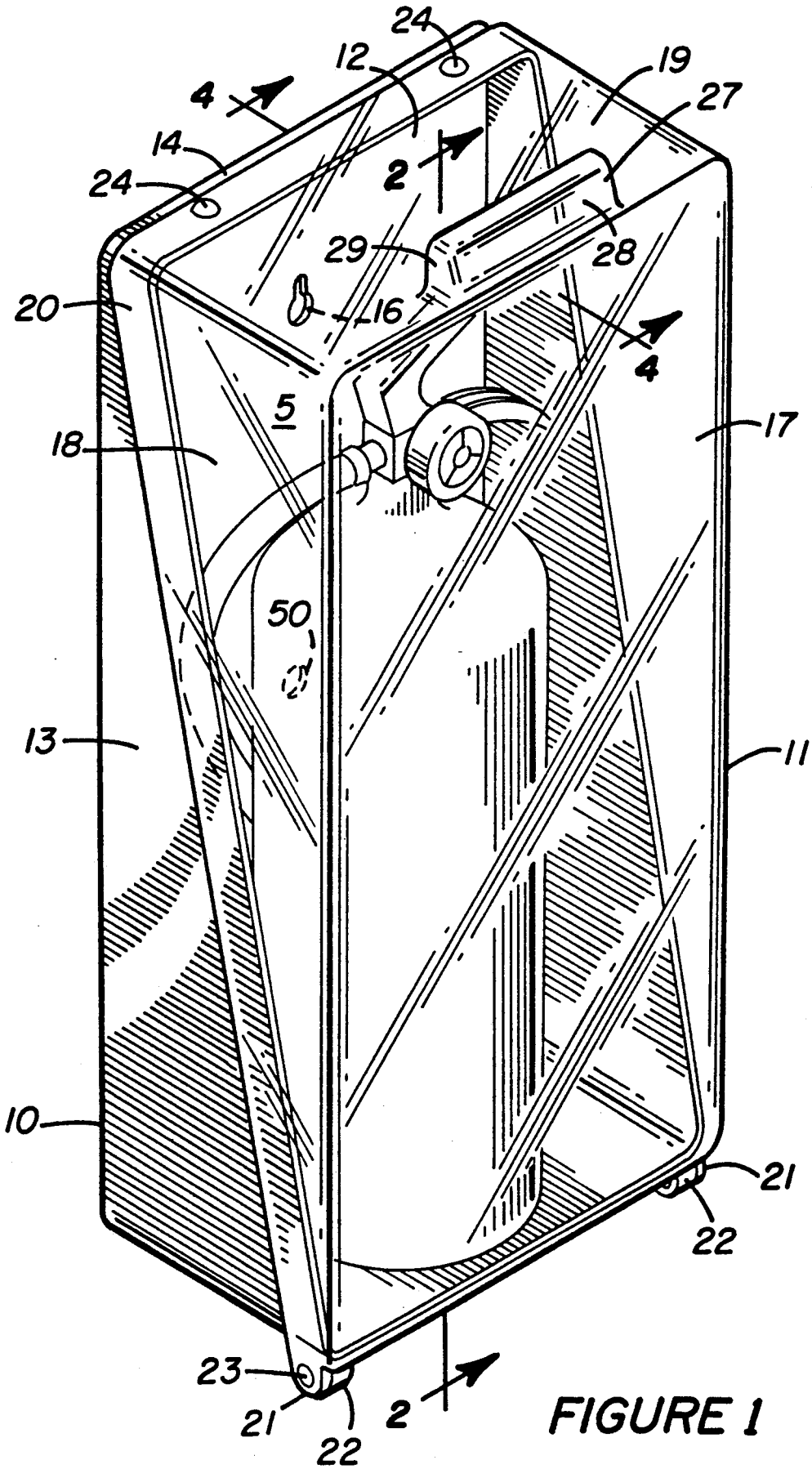
FIG. 1 is a prospective view of a fire extinguisher mounting apparatus according to the preferred embodiment of the present invention.

FIG. 1 is a perspective view of the fire extinguisher mounting apparatus according to the present invention. The primary elements of the apparatus comprise a housing 10 adapted for receiving and storing a fire extinguisher or other like stored article and an access panel 11 adapted for pivoted lockable mounting on the housing 10.

The housing 10 is essentially boxed-shaped having an elongated essentially rectangular rear wall 12, a pair of essentially flat side walls 13 extending outwardly therefrom, and a top and bottom wall 14, 15, respectfully, extending outwardly from the rear wall 12 transversely between the side walls 13 to define a containment area 5 of a size adapted to receive a standard commercial fire extinguisher unit. In the preferred embodiment form of the invention, the top wall 14 of the housing 10 is substantially smaller then the bottom wall 15. The side walls 13 are angled obliquely from the outer edge of the bottom wall 15 to the outer edge of the top wall 14 such that the angle formed at the intersection of the side wall 13 outer edge and the bottom wall 15 outer edge is between 60°-65°, and the edge of the bottom wall 15, the side walls 13 and top wall 14 is generally continuous. It will be apparent to those skilled in the art that the angle formed at the intersection of the side wall 13 outer edge and the bottom wall 14 outer edge will change with variations in the length and depth of the housing 10. By the term "generally continuous", it is intended to mean a substantially uniform periphery around the outer edge of the housing.

The housing 10 is adapted to be either recessed within a building wall or surface mounted on a building wall or other support surface mounted on a building wall or other support surface with the rear wall 12 flush against the wall or support surface. To facilitate mounting on a suitable vertical support surface such as a building wall or the like, openings 16 and 50 are formed in the rear wall 12 of the housing 10. Opening 50 is generally circular and opening 16 is generally oblong in the elongated direction of the housing rear wall 12.

The housing 10 is generally opaque and may be formed of a suitable high impact plastic, such as the conventional thermal plastic molding resin known as ABS, and may include in the molding process suitable material stabilizers and ultra-violet inhibitors for protection against facing from natural or artificial light. The housing 10 is essentially indestructible in normal handling and usage because of the particular material selected.

In the preferred embodiment form of the invention, the access panel 11 is generally symmetrically similar in size and shape to the housing 10 and when in a covering relationship thereof the resultant geometrical shape generally comprises a parallelepiped. The access panel thus includes an essentially elongated rectangular front face 17, a pair of essentially flat side walls 18 extending inwardly therefrom, and a top wall 19 extending inwardly from the front face 17 transversely between the side walls 18 to further define the containment area 5. The side walls 18 are also angled obliquely from the outer edge of the top wall 19 to the bottom edge of the front face 17 at an angle essentially equal to the oblique angle of the housing side walls 13 such that when the access panel 11 is in a covering relationship with the housing 10 the sides of the apparatus generally comprise an essentially elongated rectangle with a diagonal split therethrough and the containment area 5 is essentially sealed.

The access panel 11 also includes a peripheral lip 20 extending generally perpendicularly from the outer perimeter thereof. The access panel 1 is adapted to be mounted on the housing 10 with the peripheral is 20 disposed outwardly bout the frontal edge of the housing 10 to center the panel 11 over the housing 10 frontal opening and enclose the containment area 5.

The access panel 11 is generally transparent and may also be integrally molded of a suitable plastic material. Thus, the fire extinguisher or other like stored article is generally visible from all sides, eliminating the need for decals and/or other emergency markings.

Figures 2, 3:
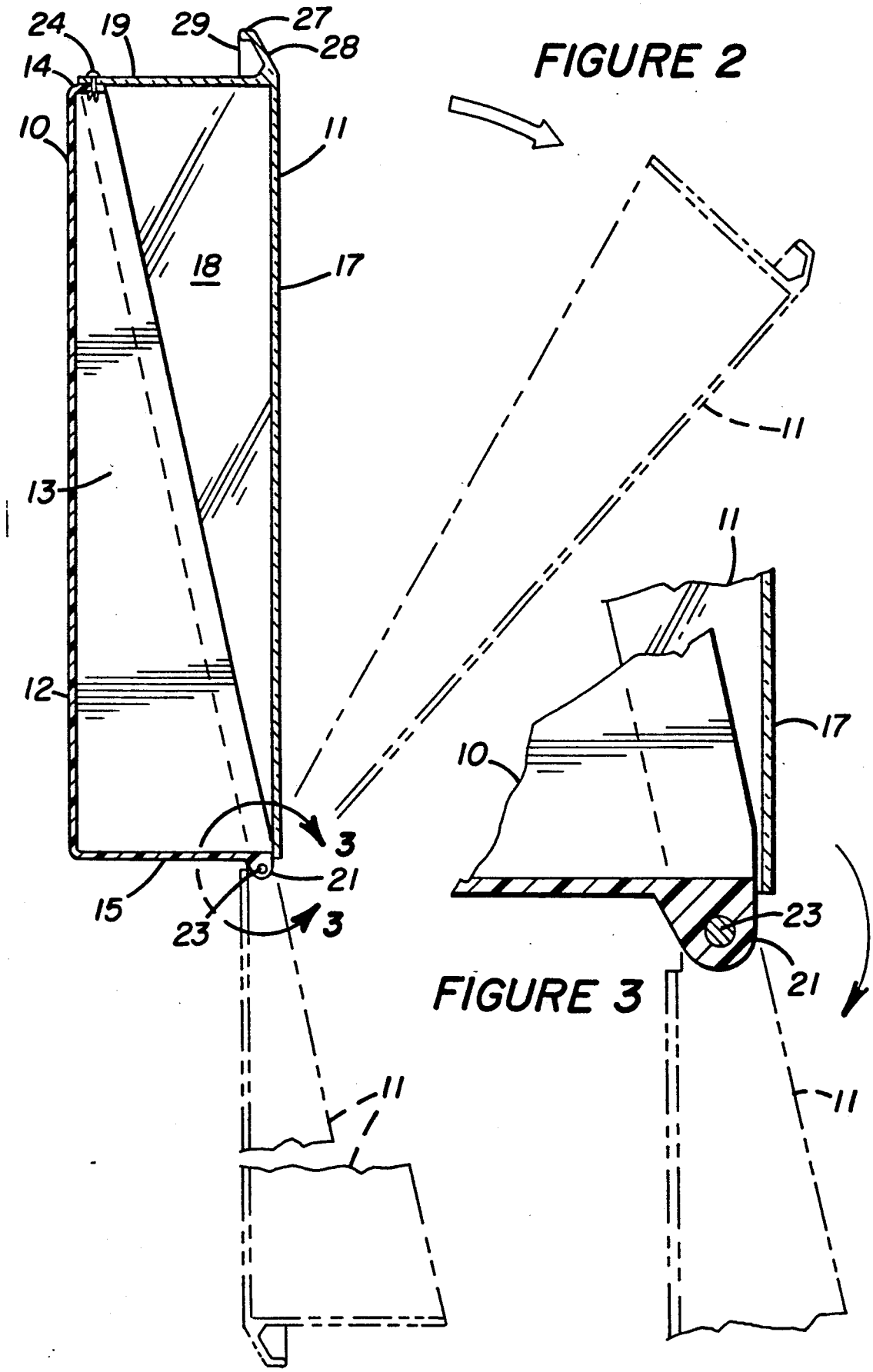
FIG. 2 is a horizontal cross-sectional view of the full fire extinguisher mounting apparatus of FIG. 1 taken along lines 2—2 thereof.
FIG. 3 is an enlarged cross-sectional view of the full fire arrangement of the fire extinguisher mounting apparatus of FIG. 1 taken along lines 3—3 thereof.

In the preferred embodiment form of the invention, a permanent mating hinge arrangement, as shown in FIGS. 2 and 3, is formed on the corresponding bottom wall 15 of the housing 10 and the bottom edge of the access panel 11 front face 17, to facilitate pivotal movement of the access panel 11 to an open and closed position. The hinge arrangement includes a pair of housing hinge bosses 21 immediately proximal the front edge of the housing 10 bottom wall 15 extending downwardly and disposed on opposite ends thereof, a pair of access panel bosses 22 immediately proximal the bottom edge of the access panel 11 front face 17 extending downwardly and disposed on opposing ends thereof, and a pair of conventional hinge pins 23.

The housing hinge bosses 21 and the access panel hinge bosses 22 have respective holes formed there through which are adapted to be aligned in such adjacent parallel disposition of the bosses 21, 22 to receive the hinge pins 23 through the aligned holes. When the hinge pins 23 are engaged in the bosses 21, 22, the resulting hinge arrangement permits pivotal movement of the access panel 11 to the open position wherein the panel 11 is sufficiently spaced from the housing 10 to permit insertion and removal of a fire extinguisher unit or like stored article into and from the containment area 5, and to the closed position wherein the access panel 11 is in a covering relationship with the housing 10.

As would be apparent to those skilled in the art, other hinge arrangements may be employed to facilitate pivotal movement of the access panel 11 to the open and closed positions.

The invention also include a simple, yet inexpensive, securing mechanism for preventative disengagement of the access panel 11 from the housing 10 when in the closed position. In the preferred embodiment form of the invention, the securing mechanism comprises a pair of replaceable frangible shear members 24 (FIG. 1) disposed at the top of the housing 10 and access panel 11 when in a closed position. The top walls of the housing and access panel 14, 19, respectively, have respective holes 25, 26 formed therethrough which, when the access panel 11 is in the closed position, are adapted to be aligned in such adjacent disposition of the walls 14, 19 to receive the shear members 24 through the aligned holes 25, 26. When the shear members 24 are engaged in the holes 25, 26, the shear members 24 facilitate secure locking of the access panel 11 in such mounted disposition on the housing 10 to prevent pivotal opening and closing movement of the access panel 11.

Figure 6:
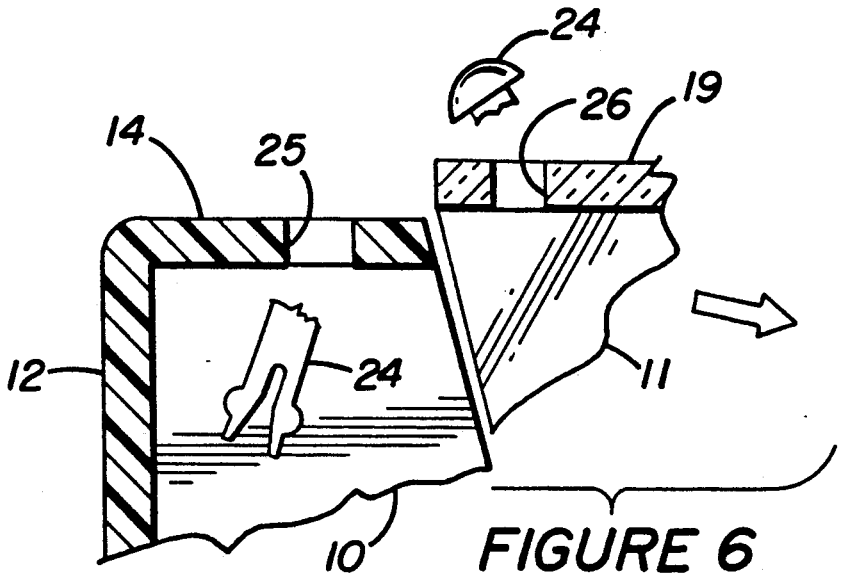
FIG. 6 is an enlarged cross-sectional view of the shear member of the fire extinguisher mounting apparatus of FIG. 1 taken along lines 3—thereof depicting disengagement of the shear member in response to a pulling force applied to the gripping member.

The shear members 24 are of sufficient frangibility in response to the application of a predetermined force to the handle means to sever the shear members 24, permitting the access panel 11 to be disengaged from the housing 10 and pivoted to the open position, as depicted in FIG. 6. Emergency access to the containment area 5 is thus made safer and more efficient with the frangible shear members 24 over conventional fire extinguisher cabinet constructions. The hazard of sharp points and edges resulting from breakage of the door or cover is eliminated, and manufacturing costs are saved by eliminating the breaker bar and chain required with most conventional fire extinguisher cabinet constructions such as the forementioned U.S. Pat. No. 4,449,588.

Figure 5:
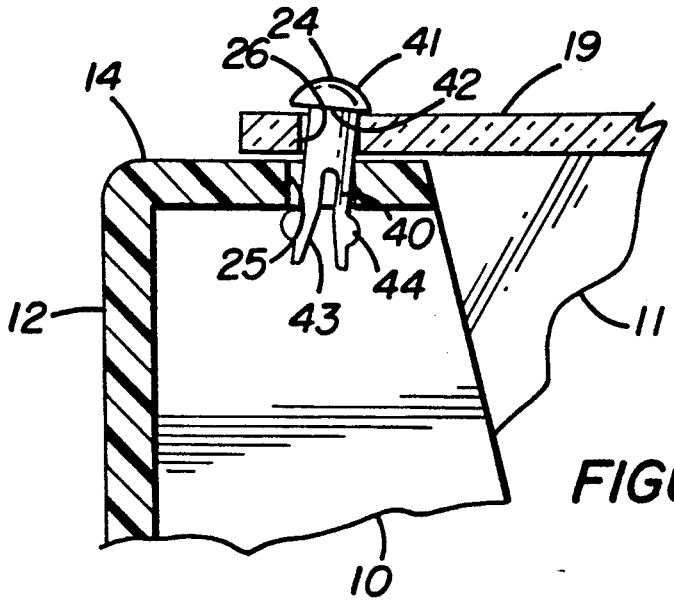
FIG. 5 is an enlarged cross-sectional view of the shear member of the fire extinguisher mounting apparatus of FIG. 1 taken along lines 3—3 thereof.

It should also be noted that he hole 25 through the housing 10 top wall 14 is slightly larger than the hole 26 through the access panel 11 top wall 19 to facilitate the shearing and resultant disengagement of the shear members 24 (see FIG. 5). It will be apparent to those skilled in the art that hole 26 may alternatively be larger than hole 25 to facilitate the shearing and resultant disengagement of the shear members 24.

Figure 4:
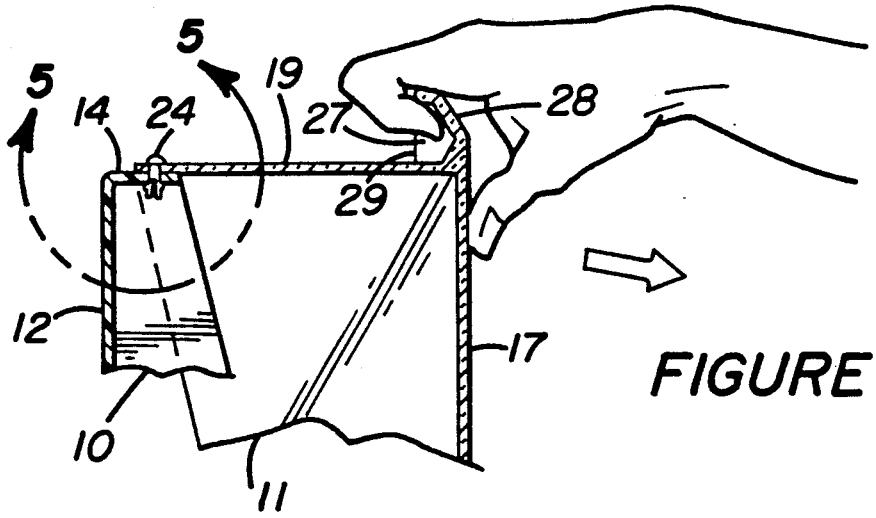
FIG. 4 is a vertical cross-sectional view of the gripping member of the fire extinguisher mounting apparatus of FIG. 1 taken along lines 3—3 thereof.

The handle means comprises a handle 27 which is formed on the top wall 19 of the access panel 11. The handle 27 includes a frontal face 28 and generally parallel sides 29. The frontal face 28 slopes rearwardly and upwardly from the top wall 19, and the sides 29 extend generally perpendicularly from the top wall 19. When the access panel 11 is in the closed position as described above, the frontal face 28 and sides 29 of the handle 27 create a recess for placement of the finger tips in a gripping fashion (see FIG. 4).

To permit emergency access to a fire extinguisher or other article stored within the containment area 5, the shear members 24 are forcibly sheared in response to a predetermined pulling force on the handle 27 by the finger tips outwardly from the housing 10 frontal opening. The pulling force is selected to be in full compliance with applicable fire regulation standards for manual opening.

To re-secure the access panel 11 in the closed position, holes 25, 26 are aligned and new shear members 24 are secured therein. The shear members 24 are designed and configured such that the shear members 24 may be readily inserted through the holes 25, 26 with a minimum amount of force. The shear members 24 are secured within the holes 25, 26 by any suitable means to render the apparatus virtually tamper proof. In the preferred embodiment form of the invention, as shown in FIG. 5, each shear member 24 comprises a pin having a generally elongated body with an essentially circular cross-section 40, a head 41 formed thereon and disposed at one end thereof with a generally flat shoulder 42 which is adapted to be seated immediately adjacent to the access panel 11 top wall 19 when the shear member 24 is engaged in holes 25, 26, and a recess 43 at the opposite end thereof with a pair of engagement tabs 44 extending outwardly and disposed immediately proximal the recess 43 and said opposite end to facilitate secure engagement of the shear member 24 in holes 25, 26.

While the embodiments of the apparatus have been disclosed with reference to specific structures, one of ordinary skill in the art can make various changes and modifications to the invention to adapt it to various uses and conditions. As such, these changes and modifications are properly, equitably, and intended to be, within the full range of equivalence of the following claims.

What is claimed is:

1. A fire extinguisher mounting apparatus for storing a fire extinguisher or other like articles, comprising:

a housing defining a containment region therein;

an access panel adapted for enclosing said containment region;

hinge means operatively connected to said housing and said access panel at corresponding edges thereof to permit pivotal interengagement of said housing and said panel;

said hinge means being permanently adapted to permit pivotal movement of said access panel to an open position wherein said panel is sufficiently spaced from said housing to permit repeated insertion and removal of a fire extinguisher or like article into and from said containment region without disengagement of said hinge means and to a closed position wherein said access panel is disposed in covering relation to said housing;

handle means connected to said access panel for manual pivoting of said access panel about said hinge means;

securing means for securing said access panel to said housing and for preventing disengagement of said access panel with said housing when in said closed position and adapted for permitting selective disengagement of said access panel from said housing to said open position, said securing means including at least one replaceable shear member separate from said hinge means and being of sufficient frangibility in response to the application of a predetermined force to said handle means to sever said shear member to permit said access panel to be disengaged from said housing and pivoted on said hinge means to said open position.

2. The apparatus of claim 1 wherein said housing and said access panel in covering relation thereto generally comprise a parallelepiped.

3. The apparatus of claim 1 wherein said housing includes a rear wall, a bottom support wall, a top wall and a pair of generally parallel side walls with an outer edge of each wall being generally continuous.

4. The apparatus of claim 3 wherein said rear wall is adapted for mounting flushly against or recessed within a supporting wall structure.

5. The apparatus of claim 3 wherein said top walls of said housing and said access panel have at least one hole formed through each which, when said access panel is in said closed position, are adapted to be aligned to receive said at least one shear member through said aligned holes.

6. The apparatus of claim 1 wherein said access panel includes a front face, at op wall and a pair of generally parallel side walls with an outer edge of each wall being generally continuous.

7. The apparatus of claim 1 wherein said access panel includes lip means projecting from an outer perimeter thereof for disposition outwardly about said housing at an opening thereof for centering said panel.

* * * * *

UNITED STATES PATENT AND TRADEMARK OFFICE

CERTIFICATE OF CORRECTION

PATENT NO. : 5,195,595

DATED : March 23, 1993

INVENTOR(S) : Henry Nakagawa

It is certified that error appears in the above-identified patent and that said Letters Patent is hereby corrected as shown below:

Column 2, line 20, delete "refers" and insert therefore --refer--.

Column 2, lines 28-29, delete "full fire" and insert therefore --hinge--.

Column 2, line 40, delete "3-" and insert therefore --3-3--.

Column 3, line 43, delete "facing" and insert therefor --fading--.

Column 3, line 14, delete "then" and insert --than--.

Column 3, line 68, delete "1" and insert therefore --11--.

Column 4, line 1, delete "is" and insert therefore --lip--.

Column 4, line 2, delete "bout" and insert therefore --about--.

Column 5, line 4, delete "forementioned" and insert therefore --aforementioned--.

Column 5, line 5, delete "he" and insert therefore --the--.

Column 6, line 27, after "position;" insert --and--.

Column 6, line 50, after "least" insert --replaceable--.

UNITED STATES PATENT AND TRADEMARK OFFICE

CERTIFICATE OF CORRECTION

PATENT NO. : 5,195,595 Page 2 of 2

DATED : March 23, 1993

INVENTOR(S) : Henry Nakagawa

It is certified that error appears in the above-indentified patent and that said Letters Patent is hereby corrected as shown below:

Column 6, line 53, delete "at op" and insert therefore --a top--.

Signed and Sealed this

Twenty-second Day of March, 1994

*Attest:*

Bruce Lehman

BRUCE LEHMAN

*Attesting Officer*

*Commissioner of Patents and Trademarks*